US007886375B2

(12) United States Patent
Thorne et al.

(10) Patent No.: US 7,886,375 B2
(45) **Date of Patent: *Feb. 15, 2011**

(54) METHOD OF PROVIDING CLEAN WATER CIRCULATING FLOW IN A BABY BATHING TUB AND A THERMALLY BUFFERED, CLEAN WATER FLOW, UNIVERSAL, TEMPERATURE INDICATING BABY BATHING TUB

(75) Inventors: Henry F Thorne, West View, PA (US); Robert D Daley, Pittsburgh, PA (US)

(73) Assignee: Thorley Industries, LLC, Pittsburgh, PA (US)

( * ) Notice: Subject to any disclaimer, the term of this patent is extended or adjusted under 35 U.S.C. 154(b) by 1126 days.

This patent is subject to a terminal disclaimer.

(21) Appl. No.: 11/560,519

(22) Filed: Nov. 16, 2006

(65) Prior Publication Data

US 2007/0256233 A1 Nov. 8, 2007

Related U.S. Application Data

(60) Provisional application No. 60/746,697, filed on May 8, 2006.

(51) Int. Cl.
*A47K 3/024* (2006.01)

(52) U.S. Cl. ..... 4/572.1

(58) Field of Classification Search ..... 4/572.1, 4/571.1, 586, 554, 559

See application file for complete search history.

(56) References Cited

U.S. PATENT DOCUMENTS

| | | | | |
|---|---|---|---|---|
| 1,512,068 | A | | 10/1924 | Thornburg |
| 4,216,552 | A | | 8/1980 | Gurolnick |
| 4,561,135 | A | | 12/1985 | Adriaansen |
| RE32,806 | E | | 12/1988 | Gurolnick |
| 4,796,312 | A | * | 1/1989 | Corlew ..... 4/555 |
| 5,054,136 | A | | 10/1991 | Inagaki |
| 5,092,001 | A | | 3/1992 | Ross et al. |
| 5,181,284 | A | | 1/1993 | Raphael et al. |
| 5,276,926 | A | | 1/1994 | Lopez |
| 5,361,430 | A | | 11/1994 | Wise |
| 5,375,271 | A | | 12/1994 | Frankel |
| 5,588,159 | A | | 12/1996 | Poulson et al. |
| 5,809,588 | A | | 9/1998 | Angelotti |
| 5,966,752 | A | | 10/1999 | Abugideiri |
| 6,037,873 | A | * | 3/2000 | Preston ..... 340/618 |
| 6,112,343 | A | | 9/2000 | Dixon |

(Continued)

*Primary Examiner*—Gregory Huson
*Assistant Examiner*—Janie Christiansen
(74) *Attorney, Agent, or Firm*—The Webb Law Firm

(57) ABSTRACT

A method bathing a baby is provided by a thermally buffered clean water flow universal baby bathing tub which includes a tub body. A baby bathing portion is formed in the tub body and a reservoir is formed in the tub body having a reservoir weir exiting the reservoir into the baby bathing portion, wherein baby bathing portion is configured to receive the bathing water from the source of bathing water through the reservoir and the reservoir weir, whereby the reservoir will provide a thermal buffer for the bathing water between the source of bathing water and the baby bathing portion. A clean water flow baby bathing tub further includes a bathing height regulating hole configured to define the conventional bathing height of the bath in the baby bathing portion. The bathing tub provides a clean water circulating flow for bathing the baby.

18 Claims, 4 Drawing Sheets

U.S. PATENT DOCUMENTS 6,158,065 A 12/2000 Tuoriniemi et al.
6,578,209 B2 6/2003 Lopes et al.
6,922,856 B2 8/2005 Mazar
2007/0033727 A1* 2/2007 Liu ..... 4/572.1

* cited by examiner

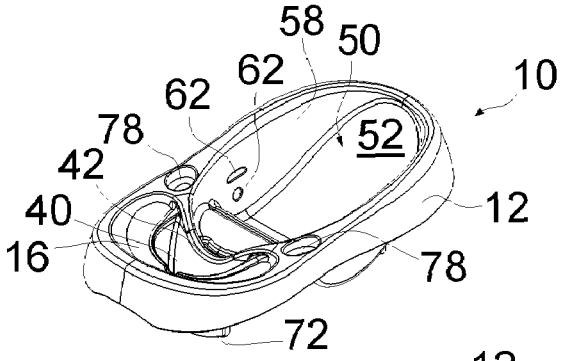
FIG. 1
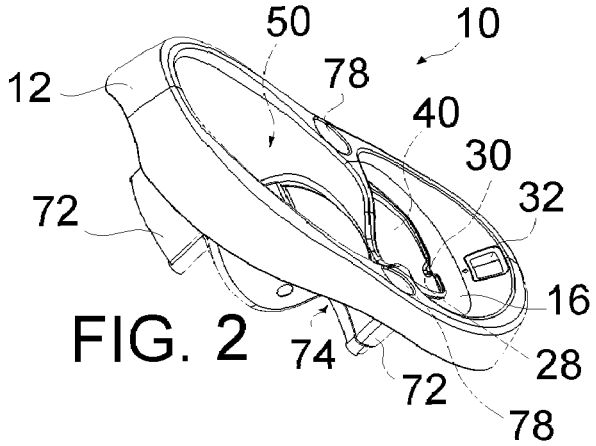
FIG. 2
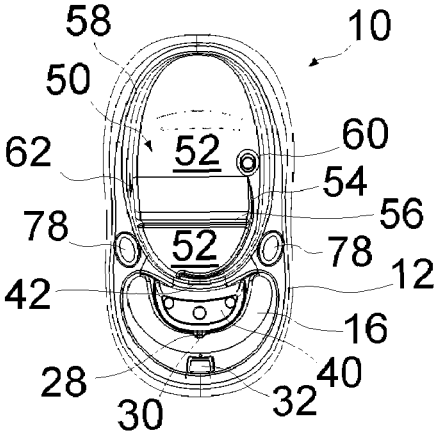
FIG. 3
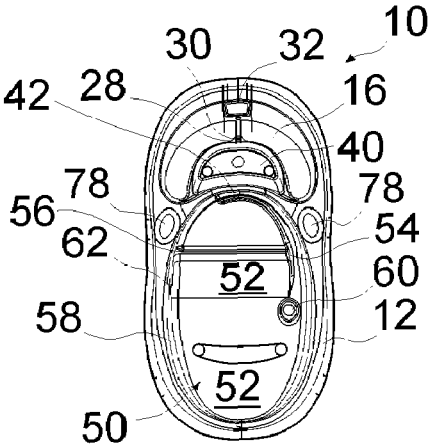
FIG. 4
FIG. 9B
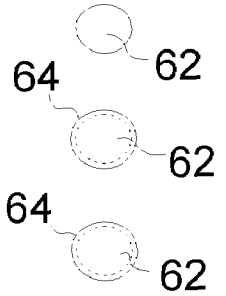
FIG. 9A
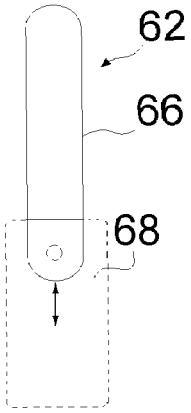
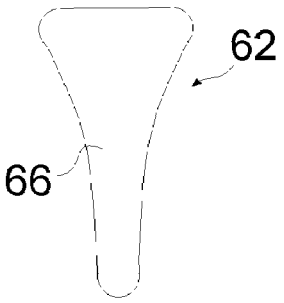
FIG. 9C
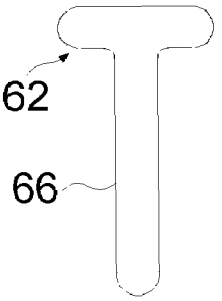
FIG. 9D

METHOD OF PROVIDING CLEAN WATER CIRCULATING FLOW IN A BABY BATHING TUB AND A THERMALLY BUFFERED, CLEAN WATER FLOW, UNIVERSAL, TEMPERATURE INDICATING BABY BATHING TUB

RELATED APPLICATIONS

This application claims the benefit of U.S. provisional patent application bearing Ser. No. 60/746,697 filed May 8, 2006 and entitled "Thermally buffered, clean water flow, universal temperature indicating baby bathing tub."

BACKGROUND

1. Field of the Invention

The present invention relates to methods of bathing a baby in a baby bathing tub and associated baby bathing tubs. More particularly the present invention is directed to a method of providing clean water flow in a baby bathing tub and a universal, thermally buffered, temperature indicating, clean water flow baby bathing tub which can implement such a method.

2. Background Information

Plastic infant and toddler bathing tubs are well known. Very young infants are unable to sit unsupported, and so are typically bathed in a reclined position. Inexpensive molded plastic tubs with integral inclined infant and toddler supports are sold for this purpose. These tubs are typically configured to be set upon a horizontal surface, such as a kitchen countertop, for use, and some of these tubs can fit in standard kitchen single basin and/or double basin sinks. Within the meaning of this application the term "baby" will collectively reference infants and toddlers. Many developments have been proposed to address baby bathing issues.

U.S. Pat. No. 6,578,209 discloses a molded baby bathing tub with two distinct baby supports, wherein the tub is useful for bathing at one time an infant reclined against the first back rest, and then, at another time, bathing a toddler seated erect against the second back rest.

U.S. Pat. No. 6,922,856 discloses a bathtub, presumably for children, with an integral temperature sensing mechanism within the wall.

U.S. Pat. No. 5,375,271 discloses a separate bath mat having temperature related indicia. This device indicates dangerous temperature ranges, i.e., above or below pre-determined threshold limits. However, it is limited in that it does not indicate the exact temperature, and it is not visible for monitoring when the water becomes cloudy, as a result of shampoo, soap, bath oil, etc.

U.S. Pat. No. 6,158,065 discloses a cylindrical shaped, "standing toddler" bathing tub that allows the child to practice standing while bathing.

U.S. Pat. No. 6,112,343 discloses a baby bathing tub with an attached hook for storing the tub on a shower rod or the like for vertical storage.

U.S. Pat. No. 5,809,588 discloses a collapsible baby tub for attachment to a conventional bath or the like.

U.S. Pat. No. 5,588,159 discloses an infant bathtub with multiple-position infant support.

U.S. Pat. No. 5,361,430 discloses a baby bath tub assembly that includes a unitary molded tub having an elongated configuration, and a hammock-like sling suspended longitudinally in the tub to support the baby in the bath water contained in the tub.

U.S. Pat. No. 5,276,926 discloses a baby bath tub and seat for bathing a baby where the seat has a headrest with an opening which is sized and shaped to accept the back of the head of the baby being bathed so as to allow the washing of the back of the baby's head without allowing soap to get into the baby's eyes or ears.

U.S. Pat. No. 5,092,001 discloses a baby bathing apparatus that is primarily intended to be locatable at the height of the rim of a conventional bathtub and positioned such that the baby is positioned in a semi-sitting position along the longitudinal length of the bathtub. With the infant bathing apparatus in place, sufficient room exists within the bathtub so that an adult may simultaneously bath with the baby.

U.S. Pat. No. 4,216,882 (RE 32,806) discloses an infant bathing device having the undersurface thereof contoured for being removable and received in resting position on a double sink.

U.S. Pat. No. 4,561,135 discloses a baby bath of one-piece molded plastic for temporary use in a single or double basin sink, or on a flat surface.

U.S. Pat. No. 1,512,068 discloses a baby bath tub with separate infant support.

These form representative examples of prior art baby bathing related devices. Numerous other examples in the patent field and commercially available designs are also known. However none of the known devices provided an efficient cost effective solution for a baby bathing tub with sufficient thermal buffering between the bathing area and the bathing water source, rapid response temperature indicating in a position sufficient to adequately address danger to the baby, clean water flow within a baby bathing tub environment, and universal left hand and right hand positioning within single and double basin sinks. The methods of bathing a baby in these prior art tubs are essentially the same. Specifically the bathing water is placed into the tub to a desired height (generally 2-6 inches) and the baby is bathed in the water. The bathing water will become dirty through the bathing process, yet the dirty bathing water remains throughout the bath. Sometimes additional water is added during a rinsing of the baby, as clean water is preferred for rinsing. If this clean water rinse procedure is used then the original bathing height of the water must be appropriately lowered to accommodate the rinse water. This procedure is less than optimal from a hygienic standpoint and for the comfort of the baby.

U.S. Pat. No. 5,966,752 discloses a baby shower device including a tub and a showerhead. This design does provide the hygienic advantage of a continuous supply of clean shower water for the baby; however it represents a somewhat uncomfortable solution for the child being showered as he is left completely out of standing water. Further, the shower exposes the child to large water temperature variations from the shower head or spout.

It is the objects of the present invention to address the deficiencies of the prior art discussed above and to do so in an efficient cost effective manner

SUMMARY OF THE INVENTION

It is noted that, as used in this specification and the appended claims, the singular forms "a," "an," and "the" include plural referents unless expressly and unequivocally limited to one referent. For the purposes of this specification, unless otherwise indicated, all numbers expressing any parameters used in the specification and claims are to be understood as being modified in all instances by the term "about." All numerical ranges herein include all numerical values and ranges of all numerical values within the recited numerical ranges.

The various embodiments and examples of the present invention as presented herein are understood to be illustrative of the present invention and not restrictive thereof and are non-limiting with respect to the scope of the invention.

According to one non-limiting embodiment of the present invention addressing at least one of the above stated objects, a method of bathing a baby in a baby bathing tub comprises the steps of providing a baby bathing tub with a bathing baby portion, supplying clean bathing water to the bathing baby portion, bathing the baby in the baby bathing portion, and allowing bathing water to flow out of the bathing baby portion during a portion of the bathing of the baby at least when the height of the water within the baby bathing portion has reached a desired bathing height. The baby bathing tub has a tub body with the baby bathing portion formed in the tub body, configured to receive a baby to be bathed therein and to receive bathing water from a source of bathing water therein, and at least one outlet from the baby bathing portion to allow water to flow out of the baby bathing portion. The supplying of clean bathing water to the bathing baby portion is from a source of bathing water and is supplied throughout the bathing of the baby in the bathing baby portion. The bathing water is allowed to flow out of the at least one outlet during a portion of the bathing of the baby at least when the height of the water within the baby bathing portion has reached a desired bathing height.

According to one non-limiting embodiment of the present invention addressing at least one of the above stated objects, a thermally buffered baby bathing tub includes a tub body, a baby bathing portion formed in the tub body, configured to receive a baby to be bathed therein and bathing water from a source of bathing water therein, and a reservoir formed in the tub body having a reservoir weir exiting the reservoir into the baby bathing portion, wherein baby bathing portion is configured to receive the bathing water from the source of bathing water through the reservoir and the reservoir weir, whereby the reservoir will provide a thermal buffer for the bathing water between the source of bathing water and the baby bathing portion.

According to one non-limiting embodiment of the present invention addressing at least one of the above stated objects, the baby bathing tub may include a temperature measurement mechanism coupled to the tub body and configured to measure the temperature of the bathing water at a position before the bathing water enters the baby bathing portion, thereby forming a temperature indicating bathing tub. The temperature measurement mechanism may be a digital temperature measurement mechanism and further includes a visual temperature display. Further, the tub may include at least one of a visual alarm and an audible alarm associated with the temperature measurement mechanism.

According to one non-limiting embodiment of the present invention addressing at least one of the above stated objects, the baby bathing tub may include a pan depression formed in the tub body which is configured to receive the water flow of a conventional single or double basin sink with the baby bathing tub facing in either of a left hand or right hand direction, thereby forming a universal baby bathing tub.

According to one non-limiting embodiment of the present invention addressing at least one of the above stated objects, the baby bathing portion may include at least one bathing height regulating hole in the sidewall thereof spaced from a floor forming surface of the baby bathing portion and configured to define the conventional bathing height of the bath in the baby bathing portion, whereby a clean water flow baby bathing tub is formed.

These and other advantages of the present invention will be clarified in the description of the preferred embodiments taken together with the attached figures.

BRIEF DESCRIPTION OF THE DRAWINGS

FIGS. 1 and 2 are top opposite side perspective views of a universal, thermally buffered, temperature indicating, clean water flow baby bathing tub according to one aspect of the present invention;

FIG. 3 is a top plan view of the universal, thermally buffered, temperature indicating, clean water flow baby bathing tub of FIGS. 1 and 2;

FIG. 4 is a bottom plan view of the universal, thermally buffered, temperature indicating, clean water flow baby bathing tub of FIGS. 1 and 2;

FIGS. 9A-D are schematic figures of alternative height regulation orifice configurations for the universal, thermally buffered, temperature indicating, clean water flow baby bathing tub according to the present invention.

DESCRIPTION OF THE PREFERRED EMBODIMENTS

Figure 7:
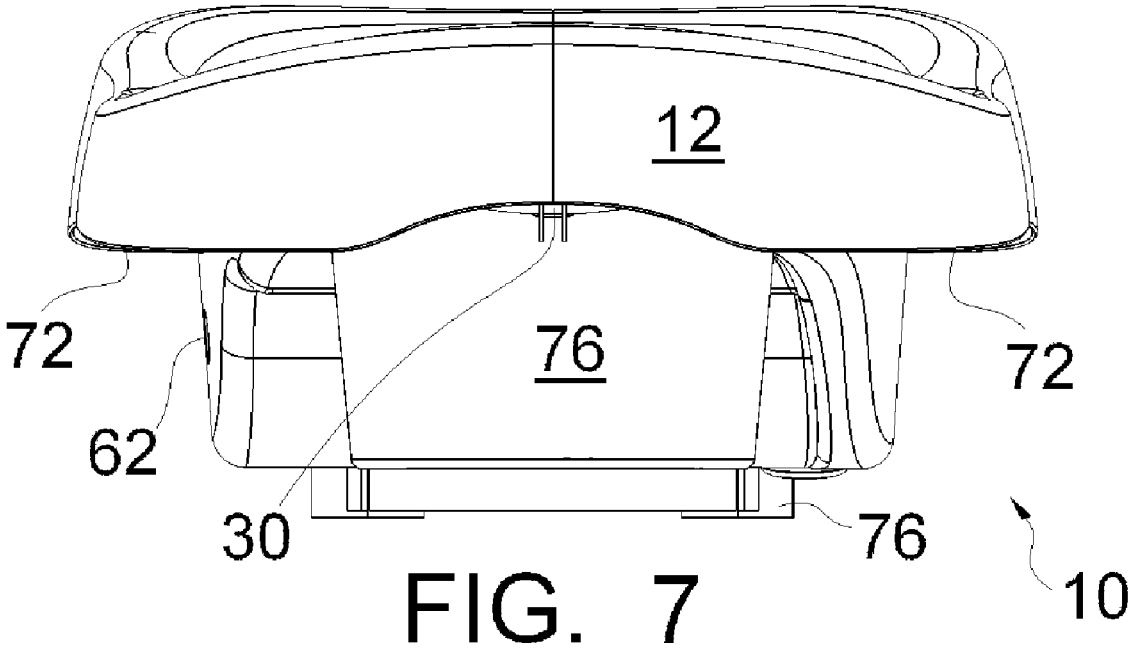
FIG. 7 is an end elevation view of the universal, thermally buffered, temperature indicating, clean water flow baby bathing tub of FIGS. 1 and 2.
Figure 5:
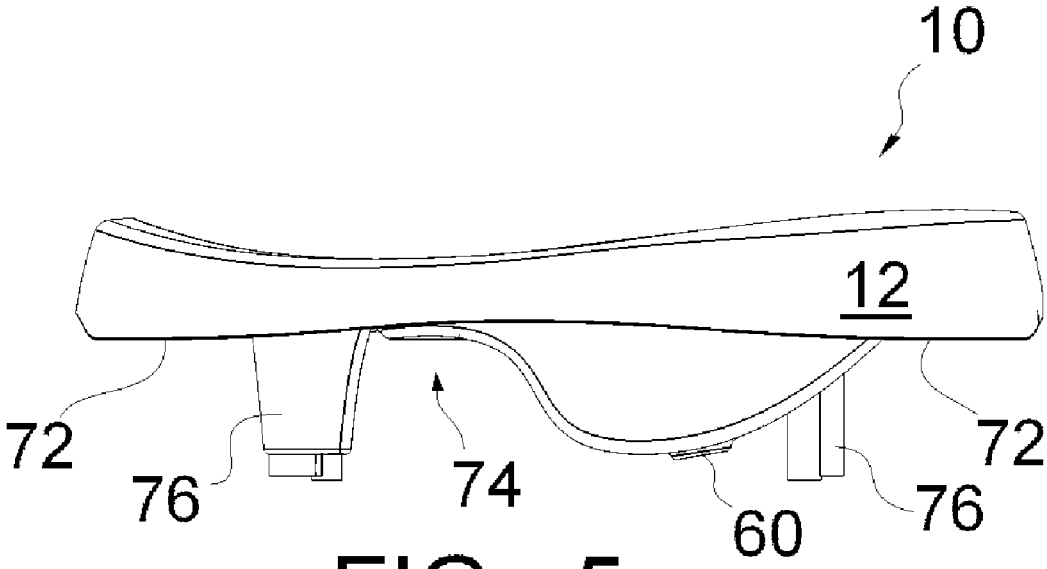
FIG. 5 is a side elevation view of the universal, thermally buffered, temperature indicating, clean water flow baby bathing tub of FIGS. 1 and 2.
Figure 8:
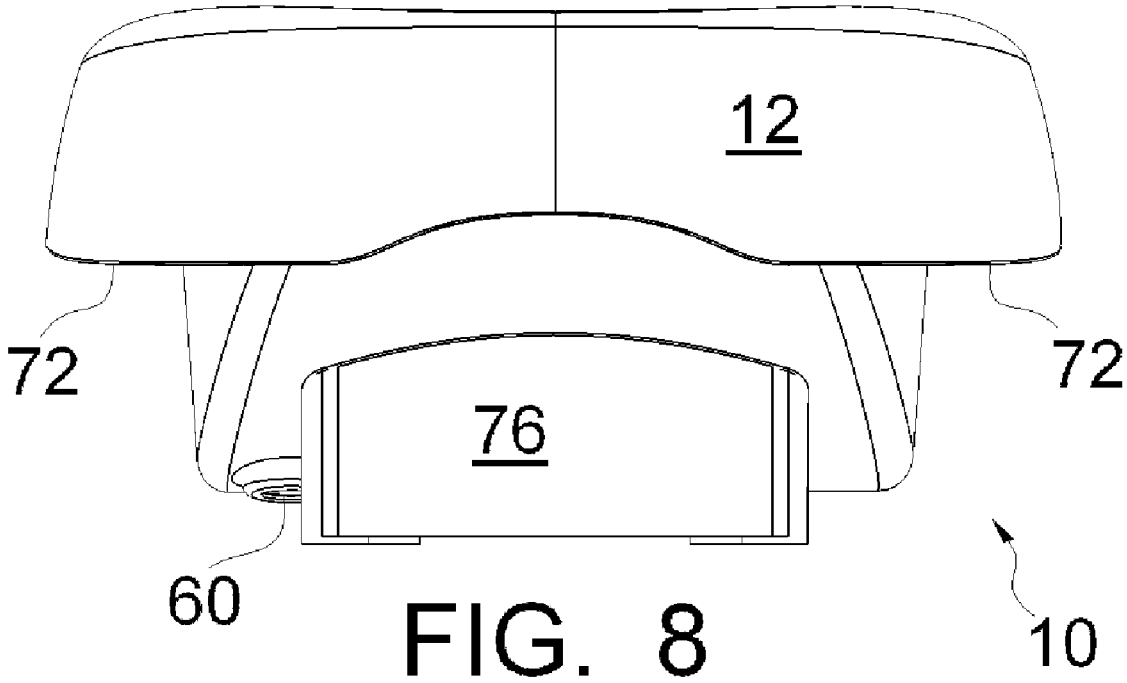
FIG. 8 is an end elevation view of the universal, thermally buffered, temperature indicating, clean water flow baby bathing tub of FIGS. 1 and 2 opposite from the end shown in FIG. 7.
Figure 6:
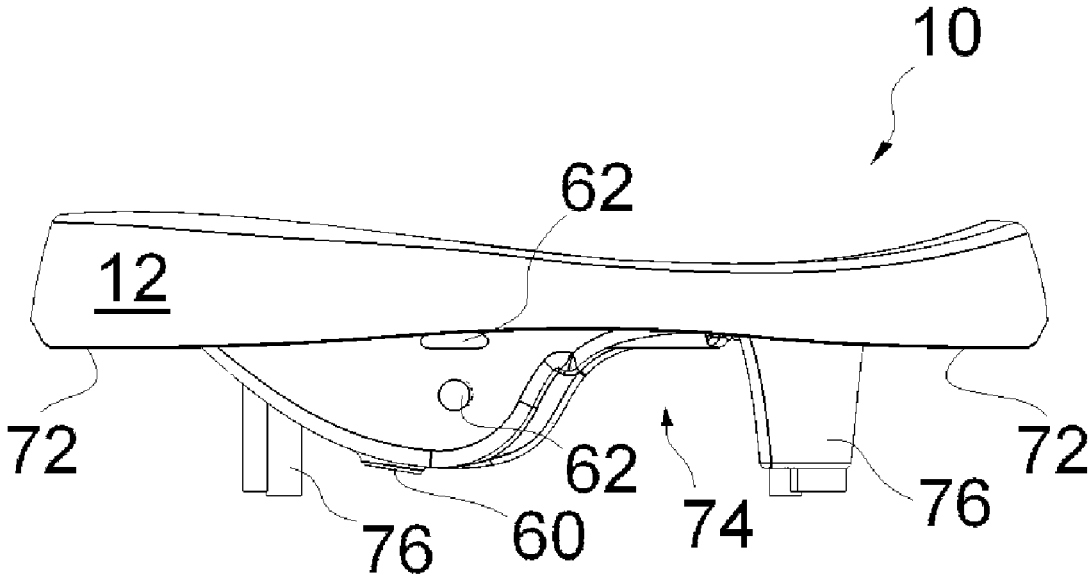
FIG. 6 is a side elevation view of the universal, thermally buffered, temperature indicating, clean water flow baby bathing tub of FIGS. 1 and 2 opposite from the side shown in FIG. 5.
Figure 10:
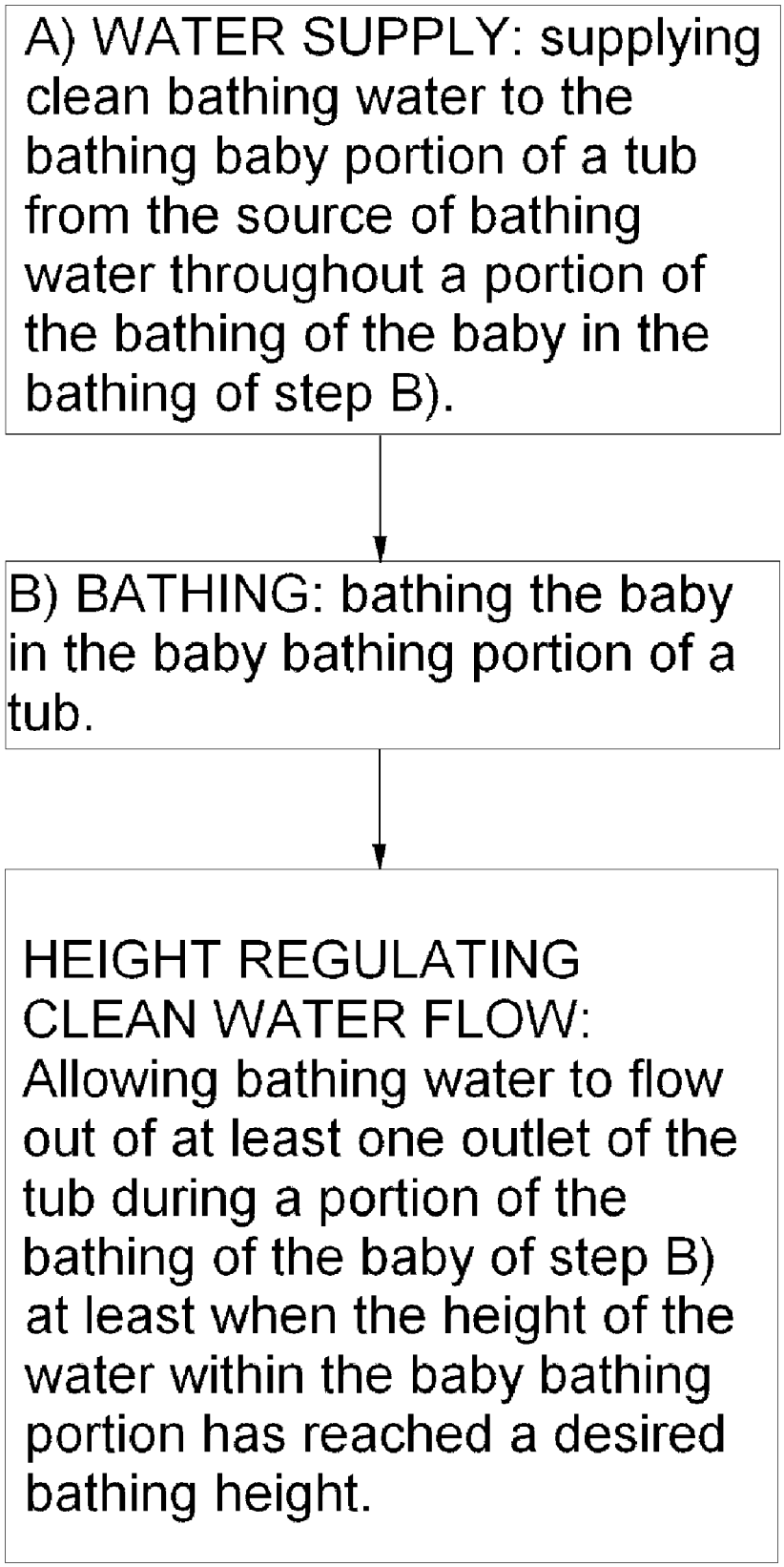
FIG. 10 is a schematic illustration of the method of bathing a baby according to one aspect of the present invention.

The FIGS. 1-8 illustrate one embodiment of a universal, thermally buffered, temperature indicating, clean water flow baby bathing tub 10 with clean water reservoir and upstream temperature sensing and alarm. The phrase "baby tub" herein will refer to both tubs designed for washing infants and tubs designed for washing toddlers. The term universal within the present application indicates that the tub 10 is designed to be effective in, at least, single basin sinks, or double basin sinks or within bathtub enclosures. Further, the term universal indicates that the tub 10 will be effective whether "facing" left or right in a sink environment. The phrase "clean water flow" in the present application indicates, as described below, that in conventional operation the bath portion of the tub 10 will receive a continuous supply of clean bathing water. The term "buffered" references that there is a thermal equalizing buffer between the source of water (i.e. the spigot or faucet) to the tub 10 and the flow of water into the bath portion. These and other aspects of the tub 10 of the present invention will be clarified in the following description.

The tub 10 includes a molded plastic body 12. A plastic material provides a hygienic, easily cleaned, cost effective material as known in the art. Other materials or forming techniques could be utilized should they become cost effective and acceptable for a baby tub. The body 12 defines a shallow catch pan depression 16 extending to the lateral left hand and right hand sides of the tub 10. The pan depression 16 is configured to receive the water flow of a conventional single or double basin sink, with the tub 10 facing either direction. The two elongated, curving depressions on either lateral side of the tub 10 that form the depression 16 allow the tub 10 to easily accommodate the vast majority of conventional sink spigot designs. In order to be meaningfully effective and "universal" within the meaning of this application, the water receiving portion (i.e. the depression 16 of the tub 10) of a baby tub must be within, at least, 10 inches of the midline of the tub. In the tub 10 of the present invention the depression 16 is well within this outer limit. In addition to receiving water from a sink spigot, the depression 16 can also easily receive water from a bathtub spigot, although receiving water from a bathtub spigot does not introduce significant design limitations as compared to sinks as there is generally greater room for tub 10 adjustments within a conventional bathtub.

The water received within the depression 16 will be directed to pan weir 28. A temperature sensor mechanism 30 is positioned within the water flow within the pan weir 28. The sensor mechanism 30 is part of a rapid temperature response for the tub 10. The term "rapid" refers to the problem that many temperature measuring devices (e.g. mercury thermometers or temperature sensing strips) have a large lag between the actual temperature changing and the reporting of that change. In this case such long lags are considered undesirable. A rapid response in accordance with the present invention is a response between change in temperature of the water and ultimate display to the user on the order of a second or less. The sensor mechanism 30 is upstream of the bathing area for the infant or toddler, close to the source of incoming water for accurate measurement of the water. The depression 16 itself will serve to remove very minor variations in the water temperature as the water flows along the depression.

The temperature sensor mechanism 30 will be part of a digital system for rapid response and can be formed as one or more standard thermistors. The thermistor(s) of the sensor mechanism 30 may be coupled to a microprocessor (not shown) which drives a digital display 32 and audible indicators and alarms (not shown). Appropriate thermistors can be provided by Digikey. Other, known digital display and sensor mechanisms may be used provided they provide accurate temperature measurements without significant lag time.

The temperature sensor mechanism 30 may be placed within the water flow through positioning the temperature sensor mechanism 30 within the pan weir 28 of the tub 10. Other positions for the temperature sensor mechanism 30 and construction of the sensor mechanism 30 are, of course possible as noted above. For example, the sensor mechanism 30 may be an array of sensors that extend across the pan weir 28. The sensor array assures that one of the sensors is in the water stream, and the controller will need to need to account for which signal is from the sensor in the water stream and therefore indicative of water temperature.

The temperature sensor mechanism 30 is coupled through a controller (not shown) to a digital temperature display 32, such as a backlit LCD numeric display, on the body 12 for displaying the temperature of the water sensed by temperature sensor mechanism 30. The digital display 32 is mounted in a direction facing the remainder of the tub 10 and is at an angle, as shown, whereby the display 32 is clearly visible from any viewing height above and adjacent to the tub 10. This allows the adult, typically the parent, to easily view the water condition while standing beside the tub 10.

In addition, it is contemplated that the display 32 may be moveable to be positioned by the user to place it in the easiest viewable position. Such structure would generally require the display to be coupled to the body 12 through an angularly adjustable mounting structure. However such movement accommodating systems may add considerable to the cost of the tub 10. The tub facing angled positioning of the display 32 is generally easily viewable and preferred from a cost perspective.

Further, the display 32 may include a visual, non-numeric display of the sensed temperature. Specifically, the display 32 may include back lighting of distinct colors, namely a tri-color system. A blue back lighting would indicate a cool or cold water temperature (relative to giving infants and toddlers a bath), a white or normal back lighting would indicate a normal temperature range for infants and toddler's bath water, and a red back lighting would indicate a dangerous condition for infants and toddler's bath water. The back lighting provides an independent non-numeric display for rapidly conveying the sensed condition to the user, effectively acting as a visual alarm. The non-numeric aspects of the digital display 32 are intended to work in conjunction with the more conventional numeric display features of the display 32, e.g. the back lighting of the display will back light a numeric display.

The temperature sensor mechanism 30 may be coupled through the controller to an audible temperature alarm on tub 10, generally associated with the display 32 and controller. The audible temperature alarm is configured to audibly signal unsafe temperature conditions sensed by the temperature sensor mechanism 30, which can be temperatures that are either too high or too low for infant and toddler bathing. The temperature sensor mechanism 30 the audible alarm and the temperature display 32 form a rapid response system having a lag time of less than 1 second between a measured temperature and the display and or alarm, if appropriate. The audible alarm may be a progressive audible temperature alarm with varied levels of activation corresponding to the severity of the scald or high temperature condition (or even sever cold condition) sensed by mechanism 30. Essentially as the sensed condition becomes more dangerous the audible alarm increases in volume, pitch, frequency or the like. The specifics of the audible alarm and the variations in possible warning signals which may be used are well known to those in the safety alarm art, in general. Any audible warning signal can be used. Further when used in conjunction with the display 32 the audible alarm need only alert the user to the general presence of dangerous conditions while the display will specify the details (e.g. the water temperature is 107 degrees Fahrenheit).

The pan weir 28 exits to a deeper reservoir 40 formed in the body 12 of the tub 10. The reservoir 40 provides a thermal buffer for the bathing water between the source of bathing water and a baby bathing area. The reservoir 40 has a reservoir weir 42 exiting the reservoir 40 into a baby bathing portion 50, wherein baby bathing portion 50 is configured to receive the bathing water from the source of bathing water through the reservoir 40 and the reservoir weir 42. The pooling of water within the reservoir 40 will provide a thermal buffer for the bathing water between the source of bathing water and the baby bathing portion 50. Consequently, minor temperature fluctuations in the water temperature will be taken out of the water due to the pooling prior to the water entering the baby bathing portion. Further, in case of unsafe water temperatures in the measured water temperature measured by temperature sensing mechanism 30, there is a buffer allowing the adult (e.g., the parent) to remedy the dangerous condition or merely the undesired condition (e.g. shut off the water flow, adjust the water temperature to the desired amount), before the unsafe or undesirable condition of the water temperature reaches the baby. The reservoir 40 may be provided with a drain and associated plug (not shown) if it desired to provide for horizontal draining after use of the tub.

The baby bathing portion 50 includes an integral contoured floor/baby back rest 52 formed in the molded body 12. The bathing portion 50 includes a single water flow channel 54 formed in the molded body 12 and extending from the reservoir weir 42 to one side of the bathing baby portion. As will described later this single side water direction better creates a continuous clean water circulation. Alternatively dual flow channels 54 could be formed on either side of the bathing portion to uniformly distribute the bathing water to within the bathing portion 50, but the single direction for improved clean water flow is preferred. A bypass channel 56 and side walls 58 also are integrally formed in the body 12 and form the remainder of the baby bathing portion 50. The channel 56 is provided to prevent the baby from forming a dam in the baby bathing portion 50 and having bathing water accumulate on one side of the bathing portion (and be drained from the opposite side).

A drain opening 60 is formed through the floor surface 52 of the body 12 to allow for complete drainage of the baby bathing portion 50 in a horizontal orientation. A conventional removable plug (not shown) is provided to close the drain opening 60 for bathing operation. More than one drain opening 60 could be provided, but a single drain opening 60 in the lowest portion of the bathing portion 50 (when horizontal) is generally sufficient, provided that the bathing portion is constructed without areas for the standing water to pool other than over the drain opening 60, as is shown in the figures. If additional "low spots" are formed in the bathing area, other drain openings would be desirable.

The baby bathing portion 50 further includes bathing height regulating holes 62 through the sidewall 58 of the body 12. The bathing height regulating holes 62 are spaced from the floor forming surface 52 and are configured to define the conventional bathing height of the bath in the baby bathing portion 50, such as about 2" to about 8" of bathing water. The holes 62 are provided at varying heights defining distinct bathing water depths. A removable plug (not shown) engages and plugs the lower hole when the desired bathing depth is defined by the upper hole 62.

It is anticipated that the bathing height regulating holes 62 may take a variety of forms. FIG. 9A illustrates an alternative arrangement in which a series of three holes 62 are provided at varying heights defining distinct bathing water depths. Removable plugs 64 engage and plug those holes at the undesired depths, although the topmost hole 62 needs no removable plug, but may be configured to receive one to act as a plug holder when one of the lower holes is being utilized. FIG. 9B illustrates an alternative arrangement in which the regulating hole 62 is in the form of an elongated slot 66 with a height adjusting weir 68 that can variably define the bathing height. FIG. 9C illustrates an alternative arrangement in which the regulating hole 62 is in the form of an elongated slot 66 with a widening configuration, whereby the flow of the water will define the bathing height and whereby the outflow "drastically" increases as the depth increases. It should be appreciated that with any hole configuration that is above the drain location, as the height of the bathing water raises from the beginning of a hole 62 to the uppermost portion of the hole 62, the effective area of the drain hole 62 that is draining water is increasing. FIG. 9C illustrates an embodiment that exaggerates this effect. FIG. 9D illustrates an alternative arrangement in which the regulating holes 62 are in the form of an elongated T-shaped slot 66 in which the height of the T effectively defines a maximum bath height. These shapes are only intended to representative of the possible height regulation orifice configurations that are contemplated within the scope of the present invention.

The regulating holes 62, in whatever particular form, provide for a continuous flow of clean water through the bath, increasing the hygiene offered by the tub 10. The holes 62 are above the floor 52 (in the configuration shown) providing a certain depth to the bath for the comfort of the baby and to provide the needed pool of bathing water. In other bathing tub configurations they could effectively be in the "floor" forming portions, provided the height is the correctly positioned as the floor member is not at the same horizontal position. Broadly speaking the holes 62 must be above the lowermost bathing portion at a height sufficient to define the desired bathtub depth.

The body 12 defines tub supports which include a sink edge engaging perimeter 72, a sink divider receiving notch 74 and supporting legs 76 that allow the tub 10 to be received in a conventional single or double basin sink as will be generally understood by those of ordinary skill in the art. The body 12 will be appropriate for either right hand or left hand orientations (i.e. whether the display 32 is facing the left or the right hand side of such a sink) within such sinks. It is the pan depression 16 configuration that is usable in either orientation that allows the tub 10 to be operated in either orientation (i.e. makes the tub Universal). The legs 76 support the tub 10 on horizontal surfaces such as a counter top or within a large conventional bathtub. The body also includes receptacles 78 formed in an upper portion thereof. The receptacles 78 are configured to receive soap bars, wash rags, shampoo bottles and the like for the convenience of the adult. Drain holes (not shown) with or without plugs may be provided, if desired, in the receptacles 78. It is further anticipated that drain holes in the receptacles 78 would be constructed to lead back into the baby bathing area such that any water received in this area would be directed, eventually, out of the drain hole 60 (or outlet 62).

The tub 10 discloses a method of bathing a baby in the baby bathing tub 10 which improves clean water flow throughout the baby bathing process. Broadly speaking the method comprises the steps of providing a baby bathing tub, such as tub 10, with a bathing baby portion, such as 50; supplying clean bathing water to the bathing baby portion; bathing the baby in the baby bathing portion; and allowing bathing water to flow out of the bathing baby portion during a portion of the bathing of the baby at least when the height of the water within the baby bathing portion has reached a desired bathing height. The baby bathing tub 10 described above has a tub body with the baby bathing portion 50 formed in the tub body, and configured to receive a baby to be bathed therein and to receive bathing water from a source of bathing water therein, and at least one outlet (the outlet 62) from the baby bathing portion 50 to allow water to flow out of the baby bathing portion 50. The supplying of clean bathing water to the bathing baby portion 50 is from a source of bathing water and is supplied throughout the bathing of the baby in the bathing baby portion 50 to supply a continuous clean water flow. The bathing water is allowed to flow out of the at least one outlet 62 during a portion of the bathing of the baby at least when the height of the water within the baby bathing portion 50 has reached a desired bathing height. The side wall mounted outlet 62 (or above the lowest point in the floor location of the outlet 62) of the tub 10 allows for a simple automatic implementation of this method, as the effective area of the outlet 62 will increase as the bathing height rises from the bottom of the outlet 62 until the outflow is matching the inflow.

It would be possible to practice the present method using only the drain outlet 60 whereby the user attempts to match the water inflow to the drain outlet flow 60 to create a constant clean flow of water into and out of the bathing portion, and the outlets 62 need not be utilized at all. However, the use of the outlets 62 avoids any need to match the water inflow and outflow. In addition to the clean water flow of the tub 10, the tub 10 provides a circulating flow in that clean water is directed to one side of the bathing area that is opposite from the outlets 62 whereby clean water is directed over the baby (as opposed to having the clean water directed directly out of the outlet 62).

Whereas particular embodiments of this invention have been described above for purposes of illustration, it will be evident to those skilled in the art that numerous variations of the details of the present invention may be made without departing from the invention as defined in the appended claims. The scope of the present invention is intended to be defined by the appended claims and equivalents thereto.

What is claimed is:

1. A method of bathing a baby in a baby bathing tub comprising the steps of:

A) providing a baby bathing tub having a tub body with a baby bathing portion formed in the tub body, configured to receive a baby to be bathed therein and to receive bathing water from a source of bathing water therein, the baby bathing portion comprising a first side wall, a second side wall opposite to and parallel with the first side wall, and a bottom wall; at least one outlet from the baby bathing portion formed on one of the first side wall and the second side wall to allow water to flow out of the baby bathing portion; and a water flow channel formed on one of the first side wall and the second side wall opposite to the at least one outlet;

B) supplying clean bathing water to the bathing baby portion from the source of bathing water throughout the bathing of the baby in the bathing tub;

C) bathing the baby in the baby bathing portion; and

D) allowing bathing water to flow out of the at least one outlet during a portion of the bathing of the baby at least when there is an accumulation of the water within the baby bathing portion used for bathing, wherein the water flow channel is configured to direct a flow of clean water over the baby and out the at least one outlet.

2. The method of bathing a baby in a baby bathing tub according to claim 1 further comprising the step of having the flow of clean bathing water into the baby bathing portion substantially equal the flow of bathing water out of the bathing baby portion to maintain a substantially uniform height of bathing water within the baby bathing portion.

3. The method of bathing a baby in a baby bathing tub according to claim 2 wherein an effective area of the at least one outlet allowing water to flow out of the baby bathing portion is varied until the flow rate of the inflow substantially equals the outflow to maintain a desired bathing height.

4. The method of bathing a baby in a baby bathing tub according to claim 1 further including the step of measuring the temperature of the bathing water temperature before the bathing water enters the baby bathing portion.

5. The method of bathing a baby in a baby bathing tub according to claim 1 wherein the at least one outlet includes a bathing height regulating hole in the sidewall of the baby bathing portion spaced from a floor forming surface of the baby bathing portion and configured to define the conventional bathing height of the bath in the baby bathing portion.

6. The method of bathing a baby in a baby bathing tub according to claim 1 further including the step of supporting the baby in an inclined position within the baby bathing portion.

7. A clean water flow baby bathing tub comprising:

a tub body with a baby bathing portion formed in the tub body having a first side wall, a second side wall, and a bottom wall, wherein the baby bathing portion is configured to receive a baby to be bathed therein and bathing water from a source of bathing water therein, the baby bathing portion further including a bathing height regulating hole provided on one of the first side wall and the second side wall; and a water flow channel formed on one of the first side wall and the second side wall opposite to the bathing height regulating hole, the bathing height regulating hole configured to define the conventional bathing height of the bath water in the baby bathing portion whereby an effective area of the hole which allows water to flow out of the baby bathing portion during a bath is varied until the flow rate of the inflow substantially equals the outflow to maintain a desired bathing height, wherein the water flow channel is configured to direct clean water over the baby and out of the bathing height regulating hole.

8. The clean water flow baby bathing tub according to claim 7 further including a reservoir formed in the tub body having a reservoir weir exiting the reservoir into the baby bathing portion, wherein baby bathing portion is configured to receive the bathing water from the source of bathing water through the reservoir and the reservoir weir, whereby the reservoir will provide a thermal buffer for the bathing water between the source of bathing water and the baby bathing portion.

9. The clean water flow baby bathing tub according to claim 7 further including a temperature measurement mechanism coupled to the tub body and configured to measure the temperature of the bathing water at a position before the bathing water enters the baby bathing portion.

10. The clean water flow baby bathing tub according to claim 7 further including a pan depression formed in the tub body which is configured to receive the water flow of a conventional single or double basin sink with the tub facing in either of a left hand or right hand direction, wherein the pan depression includes a pan weir exiting the pan depression to direct bathing water toward the baby bathing portion.

11. The clean water flow baby bathing tub according to claim 10 further including a reservoir formed in the tub body having a reservoir weir exiting the reservoir into the bathing portion, wherein the pan weir exits into the reservoir wherein the baby bathing portion is configured to receive the bathing water from the source of bathing water through the pan depression and the reservoir via the pan weir and the reservoir weir, whereby at least the reservoir will provide a thermal buffer for the bathing water between the source of bathing water and the baby bathing portion.

12. The clean water flow baby bathing tub according to claim 9 wherein the temperature measurement mechanism coupled to the tub body is a digital measurement mechanism and is configured to measure the temperature of the bathing water at the pan weir.

13. A temperature indicating baby clean water flow bathing tub comprising:

a tub body with a baby bathing portion formed in the tub body having a first side wall, a second side wall, a bottom wall, a water flow channel formed in the first side wall, and an outlet formed in the second side wall configured to allow outflow during bathing, wherein the baby bathing portion is configured to receive a baby to be bathed therein and bathing water from a source of bathing water therein while simultaneously allowing water to flow out of the outlet, further including a temperature measurement mechanism coupled to the tub body and configured to measure the temperature of the bathing water, and further wherein the water flow channel is configured to direct a flow of clean water over the baby from a side of the baby bathing portion that is opposite the outlet.

14. The temperature indicating baby bathing tub according to claim 13 wherein the outlet within the baby bathing portion includes a bathing height regulating hole in the sidewall thereof spaced from a surface forming a floor and configured to define the conventional bathing height of the bath in the baby bathing portion.

15. The temperature indicating baby bathing tub according to claim 13 further including a reservoir formed in the tub body having a reservoir weir exiting the reservoir into the bathing portion, wherein baby bathing portion is configured to receive the bathing water from the source of bathing water through the reservoir and the reservoir weir, whereby the reservoir will provide a thermal buffer for the bathing water between the source of bathing water and the baby bathing portion.

16. The temperature indicating baby bathing tub according to claim 15 further including a pan depression formed in the tub body which is configured to receive the water flow of a conventional single or double basin sink with the tub facing in either of a left hand or right hand direction, wherein the pan depression includes a pan weir exiting to the reservoir.

17. The temperature indicating baby bathing tub according to claim 13 wherein the outlet in the baby bathing portion further including a bathing height regulating hole in the sidewall thereof spaced from a floor forming surface thereof and configured to define the conventional bathing height of the bath in the baby bathing portion.

18. The temperature indicating baby bathing tub according to claim 13 wherein the temperature measurement mechanism is a digital temperature measurement mechanism and further includes a visual temperature display.

* * * * *

UNITED STATES PATENT AND TRADEMARK OFFICE

CERTIFICATE OF CORRECTION

PATENT NO. : 7,886,375 B2
APPLICATION NO. : 11/560519
DATED : February 15, 2011
INVENTOR(S) : Thorne et al.

It is certified that error appears in the above-identified patent and that said Letters Patent is hereby corrected as shown below:

Face of the Patent, See Item (57) ABSTRACT, line 1, "A method bathing"
should read: -- A method of bathing --

Face of the Patent, See Item (57) ABSTRACT, line 5, "wherein baby bathing"
should read: -- wherein the baby bathing --

Column 9, line 52, Claim 2, "equal the flow" should read -- equal to the flow --

Column 10, line 31, Claim 8, "wherein baby bathing" should read -- wherein the baby bathing --

Column 11, line 22, Claim 15, "wherein baby bathing" should read -- wherein the baby bathing --

Signed and Sealed this
Tenth Day of May, 2011

David J. Kappos

David J. Kappos
*Director of the United States Patent and Trademark Office*